US011705628B2

(12) United States Patent
Pokorny

(10) Patent No.: US 11,705,628 B2
(45) Date of Patent: Jul. 18, 2023

(54) CANCELATION CIRCUIT FOR RADIO FREQUENCY ANTENNA SYSTEMS

(71) Applicant: Ademco Inc., Golden Valley, MN (US)

(72) Inventor: Michal Pokorny, Brno (CZ)

(73) Assignee: Ademco Inc., Golden Valley, MN (US)

( * ) Notice: Subject to any disclaimer, the term of this patent is extended or adjusted under 35 U.S.C. 154(b) by 0 days.

(21) Appl. No.: 17/545,012

(22) Filed: Dec. 8, 2021

(65) Prior Publication Data

US 2022/0094049 A1 Mar. 24, 2022

Related U.S. Application Data

(62) Division of application No. 16/541,638, filed on Aug. 15, 2019, now Pat. No. 11,251,522.

(51) Int. Cl.
*H01Q 1/52* (2006.01)
*H01Q 23/00* (2006.01)
*H01Q 21/28* (2006.01)

(52) U.S. Cl.
CPC ..... *H01Q 1/523* (2013.01); *H01Q 23/00* (2013.01)

(58) Field of Classification Search
CPC ..... H01Q 1/523; H01Q 23/00; H01Q 1/243; H01Q 1/273; H01Q 21/28; H01Q 1/521
See application file for complete search history.

(56) References Cited

U.S. PATENT DOCUMENTS 8,059,046 B2 11/2011 Nysen
8,086,211 B2 12/2011 Johnson
2005/0069063 A1* 3/2005 Waltho ..... H04B 1/525 375/346
2008/0293446 A1* 11/2008 Rofougaran ..... H01L 25/0657 455/552.1
2014/0011460 A1* 1/2014 Ali ..... H04B 17/13 455/75
2015/0255863 A1 9/2015 Yoshida
2016/0190676 A1 6/2016 Miura
2019/0319346 A1 10/2019 Pokorny

FOREIGN PATENT DOCUMENTS

CN 109546330 A 3/2019

OTHER PUBLICATIONS

Li Linsheng et al. "T-shaped decoupling network for wideband isolation improvement between two strongly coupled antennas", 2015 Loughborough Antennas & Propagation Conference (LAPC), IEEE, Nov. 2, 2015, 4 pgs.
Extended European Search Report for European Patent Application No. 20167633.5, dated Sep. 22, 2020, 10 pgs.
Diallo et al., Study and Reduction of the Mutual Coupling Between Two Mobile Phone PIFAs Operating in the DCS1800 and UMTS Bands, IEEE Transactions on Antennas and Propagation, 12 pgs.

* cited by examiner

*Primary Examiner* — Wei (Victor) Y Chan
(74) *Attorney, Agent, or Firm* — Fredrikson & Byron, P.A.

(57) ABSTRACT

A radio frequency antenna system is provided and can include a radio printed circuit board, a first antenna element located proximate an edge of the radio printed circuit board, a second antenna element located proximate the edge of the radio printed circuit board, and a cancelation circuit located on the radio printed circuit board and connected to feeding points of the first antenna and the second antenna, wherein the cancelation circuit can provide a cancelation effect at output ports of the cancelation circuit with respect to signals broadcast by the first antenna element and the second antenna element over air.

6 Claims, 14 Drawing Sheets

CANCELATION CIRCUIT FOR RADIO FREQUENCY ANTENNA SYSTEMS

RELATED APPLICATION

This application is a divisional of U.S. patent application Ser. No. 16/541,638, filed Aug. 15, 2019 the entire contents of which is incorporated herein by reference.

TECHNICAL FIELD

The present invention relates generally to radio frequency (RF) antenna systems. More particularly, the present invention relates to a cancelation circuit for RF antenna systems.

BACKGROUND

Known RF antenna systems attempt to balance several different factors during the design process, such as achieving a small size, allowing for modular usage, preventing vendor lock in, and achieving reliability and good performance. However, known RF antenna systems are not capable of achieving an ideal performance with respect to all of these factors and, therefore, are forced to make specific tradeoffs. For example, as seen in FIG. 1, one known RF antenna system employing a diversity system solution consists of two orthogonally arranged F-type antennas, but as seen in FIG. 2, this RF antenna system results in poor isolation between the antennas, thereby wasting any benefits of the diversity system and introducing a dependency on a specific type of RF switch or diversity front-end module that can result in vendor lock in. As further seen in FIG. 2, this RF antenna system results in poor isolation between a side one of the antennas and a base printed circuit board (PCB), thereby introducing a performance dependency of both of the antennas on a design of the base PCB and introducing noise injection from circuitry of the base PCB to the antennas, which significantly impacts Total Isotropic Sensitivity (TIS) characteristics of the RF antenna system and degrades radio link performance.

In view of the above, there is a need and an opportunity for improved RF antenna systems.

DETAILED DESCRIPTION

Figure 1:
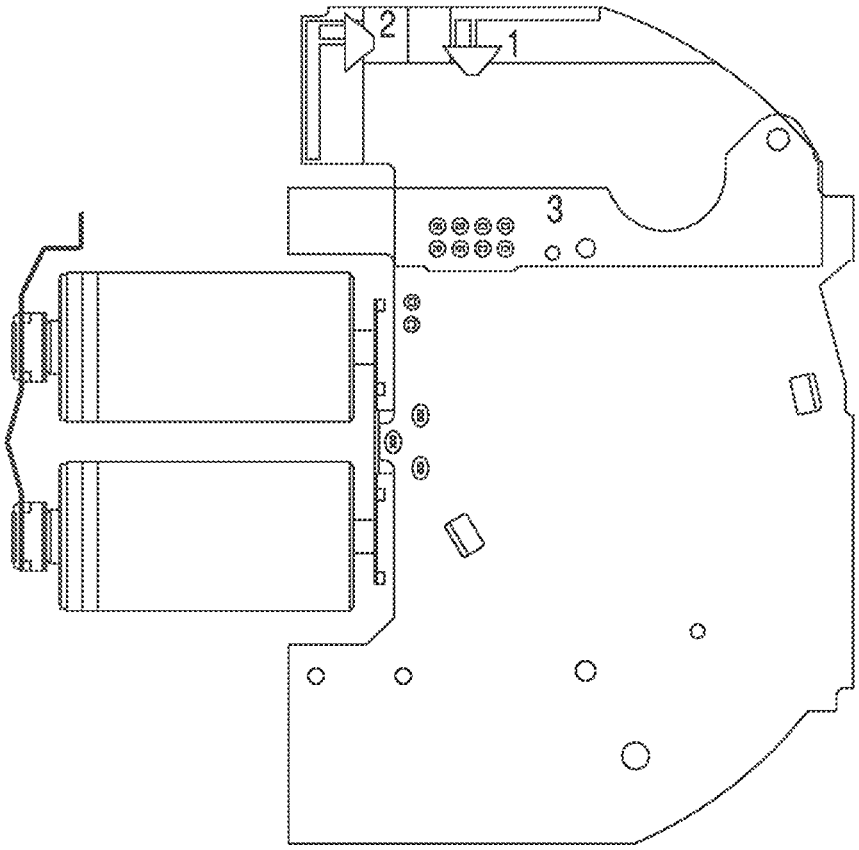
FIG. 1 Prior Art
FIG. 1 is a schematic diagram of an antenna system known in the art.

While this invention is susceptible of an embodiment in many different forms, specific embodiments thereof will be described herein in detail with the understanding that the present disclosure is to be considered as an exemplification of the principles of the invention. It is not intended to limit the invention to the specific illustrated embodiments.

Embodiments disclosed herein can include an RF antenna system that includes an antenna diversity system with (1) two antennas that are co-linear and proximate to an edge of a radio PCB that is farthest from a base PCB to provide isolation between the two antennas and the base PCB and (2) a cancelation circuit connected between feeding points of the two antennas to maintain isolation between the two antennas. For example, the RF antenna system described herein can include the radio PCB, a first antenna element located proximate the edge of the radio PCB, a second antenna element located proximate the edge of the radio PCB, and the cancelation circuit located on the radio PCB and connected to the feeding points of the first antenna element and the second antenna element, wherein the cancelation circuit can provide a cancelation effect at output ports of the cancelation circuit with respect to signals broadcast by the first antenna element and the second antenna element over air. In some embodiments, the edge of the radio PCB can be on a long side of the radio PCB.

In some embodiments, the RF antenna system can include the base PCB coupled to a connection end of the radio PCB such that the long end of the radio PCB can be opposite the connection end of the radio PCB, and in some embodiments, performance of the radio PCB can be independent of a design of the base PCB. In particular, in embodiments in which the first antenna element and the second element are arranged co-linearly with the feeding points facing each other at the long end of the radio PCB, a configuration of the first and second antenna elements, the radio PCB, and the base PCB can provide very good isolation between the first and second antenna elements and the base PCB, thereby ensuring that the performance of the first and second antenna elements is independent of a design of the base PCB and that there is very good isolation from noise sources on the base PCB, which can improve TIS characteristics and enhance an overall radio link performance. This independence can, in turn, enable production of a small antenna diversity module and modular usage and re-usage of the radio PCB with a variety of different base PCBs with minimal or zero design changes. Furthermore, the performance of the RF antenna system can be independent of an RF switch and any front-end characteristics and can compensate for PCB material variations, thereby preventing vendor lock in.

In some embodiments, a length of the radio PCB can be configured to appropriately accommodate a co-linear configuration of the first and second antenna elements, and a height of the radio PCB can be configured to provide sufficient isolation between the first and second antenna elements and a board to board connector that couples the radio PCB to the base PCB. For example, in some embodiments, the height of the radio PCB can be approximately a quarter wavelength of an operation frequency of the first and second antenna elements to provide the sufficient isolation at a minimal board area between the first and second antenna elements and the board to board connector. Furthermore, in some embodiments, the length of the radio PCB can be approximately a half wavelength of the operation frequency of the first and second antenna elements or more than the half wavelength to provide the sufficient isolation to the board to board connector. Further still, in non-modular embodiments that include standalone devices, because the isolation with respect to the board to board connector is irrelevant, various dimensions and shapes of the radio PCB can include any that are contemplated by one of ordinary skill in the art, such as round.

The configuration of the first and second antenna elements, the radio PCB, and the base PCB described herein is not typically employed in known RF antenna systems because such a configuration typically produces poor isolation between the first and second antenna elements, thereby limiting or eliminating any potential benefits of such a design. However, the RF antenna system described herein can overcome this known problem with the cancelation circuit described herein to maintain a desired level of isolation between the first and second antenna elements. In some embodiments, the cancelation circuit can also provide precise resonance tuning and impedance matching for the first and second antenna elements and eliminate any need for extra connection points to bodies of the first and second antenna elements, thereby reducing an overall size of the RF antenna system.

In some embodiments, the cancelation circuit can include lumped-element components for further size reduction. For example, in some embodiments, the lumped-element components can be arranged in a symmetric filter topology (e.g. a low-pass filter topology or a high-pass filter topology) to provide a phase shift on signals conducted through the cancelation circuit to provide the cancelation effect. In such embodiments, changes to lengths, capacitance, or inductance of the lumped-element components can change a frequency at which the cancelation effect occurs.

Figure 3:
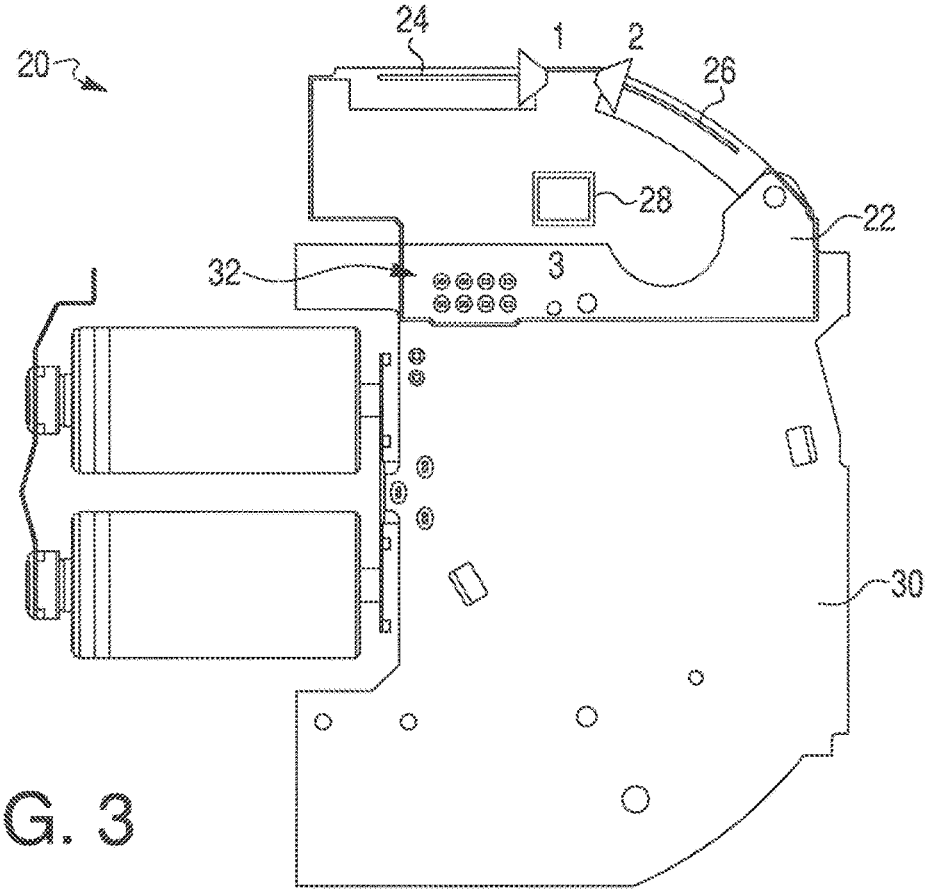
FIG. 3 is a schematic diagram of an antenna system according to disclosed embodiments.

FIG. 3 is a schematic diagram of an RF antenna system 20 according to disclosed embodiments. As seen in FIG. 3, the RF antenna system 20 can include a radio PCB 22, a first antenna element 24 located proximate an edge of the radio PCB 22, a second antenna element 26 located proximate the edge of the radio PCB 22, and a cancelation circuit 28 located on the radio PCB 22 and connected to feeding points of the first antenna element 24 and the second antenna element 26 via the radio PCB 22. As further seen in FIG. 3, the RF antenna system 20 can include a base PCB 30 coupled to the radio PCB 22 via a board to board connector 32.

Figure 4:
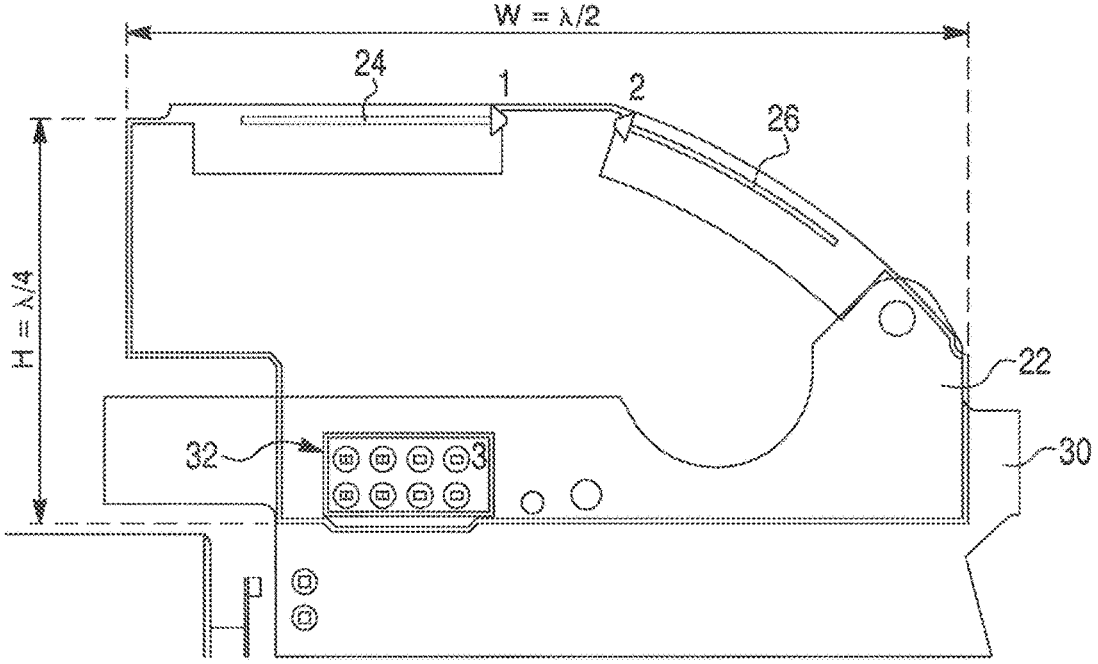
FIG. 4. is a schematic diagram of an antenna system according to disclosed embodiments.

FIG. 4 is a schematic diagram of a top portion of the RF antenna system 20 according to disclosed embodiments. As seen in FIG. 4, in some embodiments, a height H of the radio PCB 22 can be approximately λ4 (i.e., a quarter wavelength of an operation frequency of the first antenna element 24 and the second antenna element 26), and in some embodiments, a length W of the radio PCB 22 can be approximately λ2 (i.e., a half wavelength of the operation frequency of the first antenna element 24 and the second antenna element 26).

Figure 5:
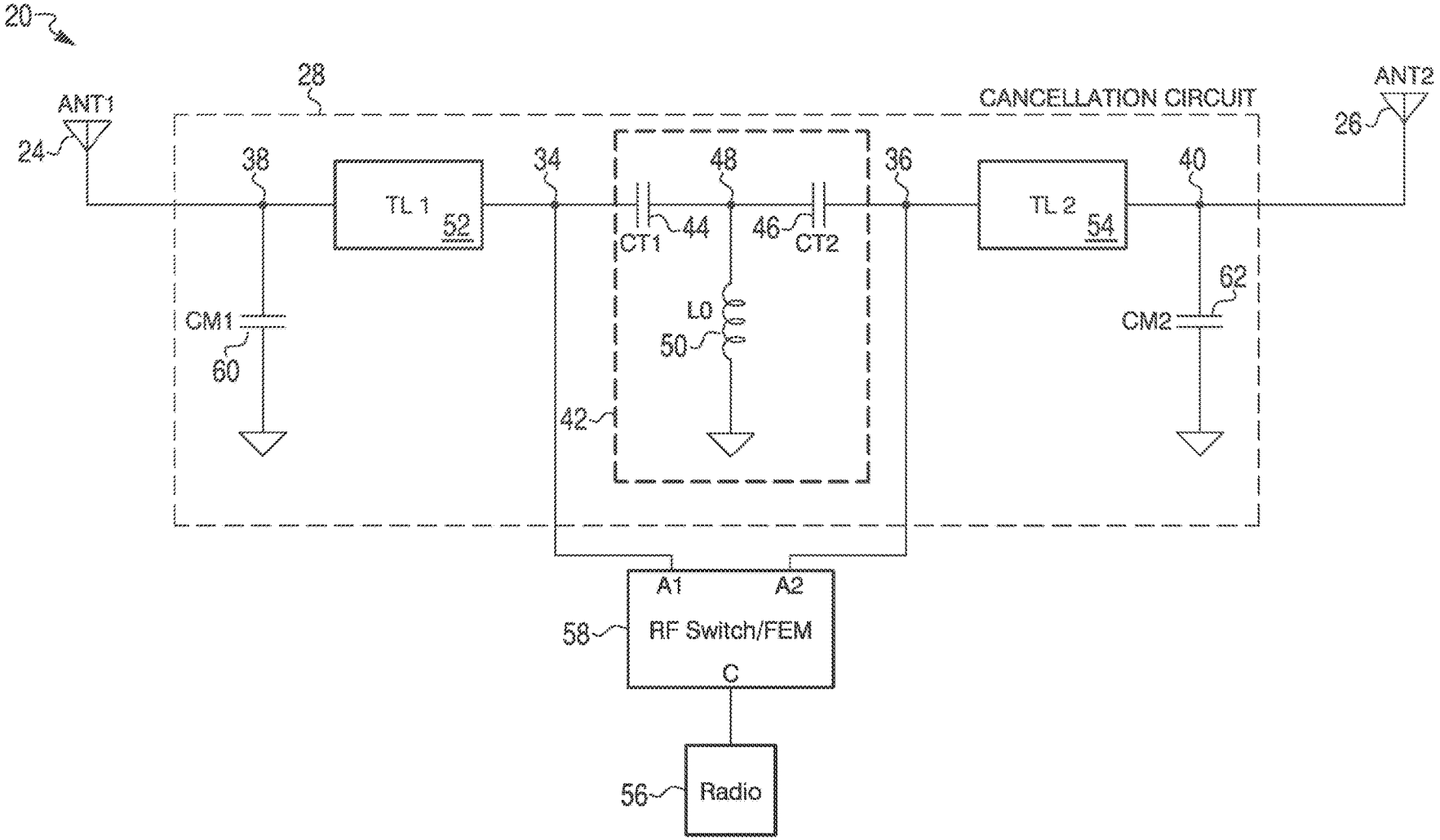
FIG. 5 is a schematic diagram of an antenna system according to disclosed embodiments.

FIG. 5 is a schematic diagram of the RF antenna system 20 according to disclosed embodiments. As seen in FIG. 5, in some embodiments, the cancelation circuit 28 can include a first radio connection point 34, a second radio connection point 36, a first antenna feed point 38 electrically coupled to the first radio connection point 34, a second antenna feed point 40 electrically coupled to the second radio connection point 36, and a filter 42 electrically coupled between the first radio connection point 34 and the second radio connection point 36 to provide a cancelation effect as described below.

As also seen in FIG. 5, in some embodiments, the filter 42 can include at filter. For example, the filter 42 can include a first capacitor 44 electrically coupled to the first radio connection point 34, a second capacitor 46 electrically coupled to the second radio connection point 36 and to the first capacitor 44 at a capacitor connection point 48, and an inductor 50 electrically coupled between ground and the capacitor connection point 48. Furthermore, in some embodiments, a first transmission line 52 can electrically couple the first radio connection point 34 to the first feed connection point 38, and a second transmission line 54 can electrically couple the second radio connection point 36 to the second feed connection point 40. Further still, in some embodiments, the first and second radio connection points 34, 36 can be electrically coupled to a radio 56 via an RF switch 58.

As seen in FIG. 5, in some embodiments, the cancelation circuit 28 can also include a first impedance shunt capacitor 60 electrically coupled between the ground and the first antenna feed point 38 and a second impedance shunt capacitor 62 electrically coupled between the ground and the second antenna feed point 40. In these embodiments, the first impedance shunt capacitor 60 and the second impedance shunt capacitor 62 can compensate for an inductive part of impedance of the RF antenna system 20 loaded by the filter 42. Furthermore, in these embodiments, the first impedance shunt capacitor 60 and the second impedance shunt capacitor 62 can maintain an impedance match of the RF antenna system 20 at 50 Ohms. For example, in some embodiments, the first impedance shunt capacitor 60 can have a capacitance of 2.3 pF, and the second impedance shunt capacitor 62 can have a capacitance of 2 pF.

In operation, the filter 42 can provide the cancelation effect at the first radio connection point 34 and the second radio connection point 36 with respect to signals originating from the radio 56 and broadcast over air by the first antenna element 24 and the second antenna element 26. For example, in some embodiments, the filter 42 can provide a phase shift on signals conducted through the cancelation circuit 28 to provide the cancelation effect. In some embodiments, the filter 42 can operate in a pass-band, and a frequency of a stop-band can be below the operational frequency of the first antenna element 24 and the second antenna element 26. Furthermore, in some embodiments, the first transmission line 52, the second transmission line 54, the first impedance shunt capacitor 60, and the second impedance shunt capacitor 62 can introduce additional phase shift parameters, and the phase shift provided by the filter can account for these additional phase shift parameters.

In some embodiments, changes to a capacitance CT1 of the first capacitor 44, a capacitance CT2 of the second capacitor 46, inductance L0 of the inductor 50, and/or lengths of the first transmission line 52 and the second transmission line 54 can change a frequency at which the cancelation effect occurs. For example, in some embodiments, the frequency at which the cancelation effect occurs can be adjusted by varying L0 and/or a value CT0, where CT0=1/(1/CT1+1/CT2). It is to be understood that the operational frequency of the first antenna element 24 and the second antenna element 26 can be adjusted by changing CT1 and CT2. However, because a ratio of antenna resonance A1 of the first antenna element 24 to antenna resonance A2 of the second antenna element 26 (i.e., A1/A2) at the first and second radio connection points 34, 36 is proportional to a ratio of CT1/CT2, CT0 can be constant to avoid affecting the frequency at which the cancelation effect occurs. In some embodiments, L0 can be 1.3 nH, CT1 can be 2.2 pF, and CT2 can be 1.6 pF. However, in some embodiments, L0 can be 3 nH, CT1 can be 3.8 pF, and CT2 can be 1.8 pF.

Figure 6:
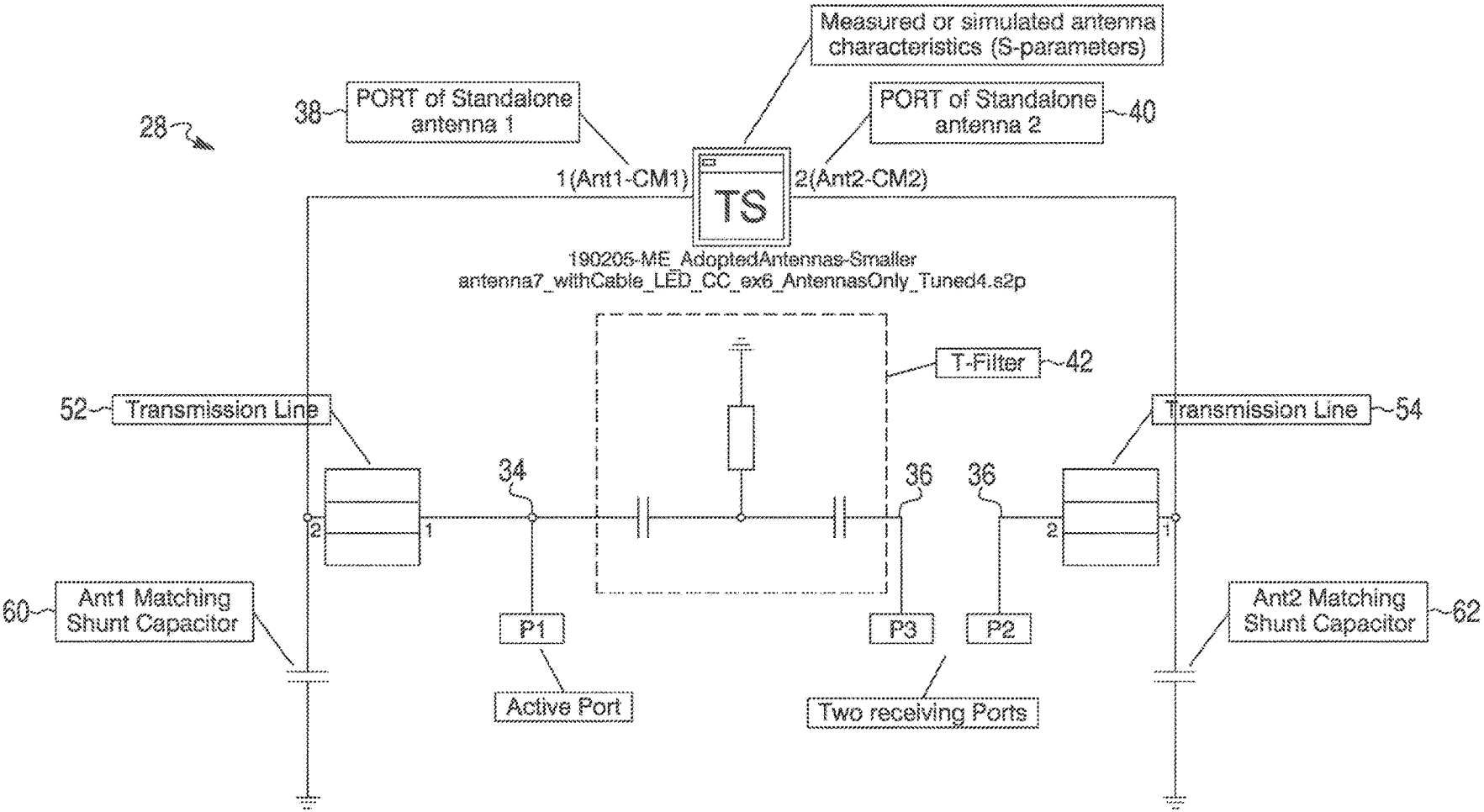
FIG. 6 is a schematic diagram of a cancelation circuit according to disclosed embodiments.

FIG. 6 is a schematic diagram of the cancelation circuit 28 according to disclosed embodiments. As described herein, the cancelation effect is based on a superposition of two signals with opposite phase. In particular, there are two signal paths for the RF antenna system 20: (1) over the air and (2) through the cancelation circuit 28. As seen in FIG. 6, the first radio connection point 34 can include an active antenna port P1 that can receive a signal to be broadcast (e.g., from the radio 56), and the second radio connection point 36 can include a first receiving port P2 and a second receiving port P3 such that the first receiving port P2 can receive a signal through the second antenna element 26 and the second transmission line 54 (e.g., a path from P1 to P2) and the second receiving port P3 can receive a signal through the cancelation circuit 28 (e.g., a path from P1 to P3).

Figure 7:
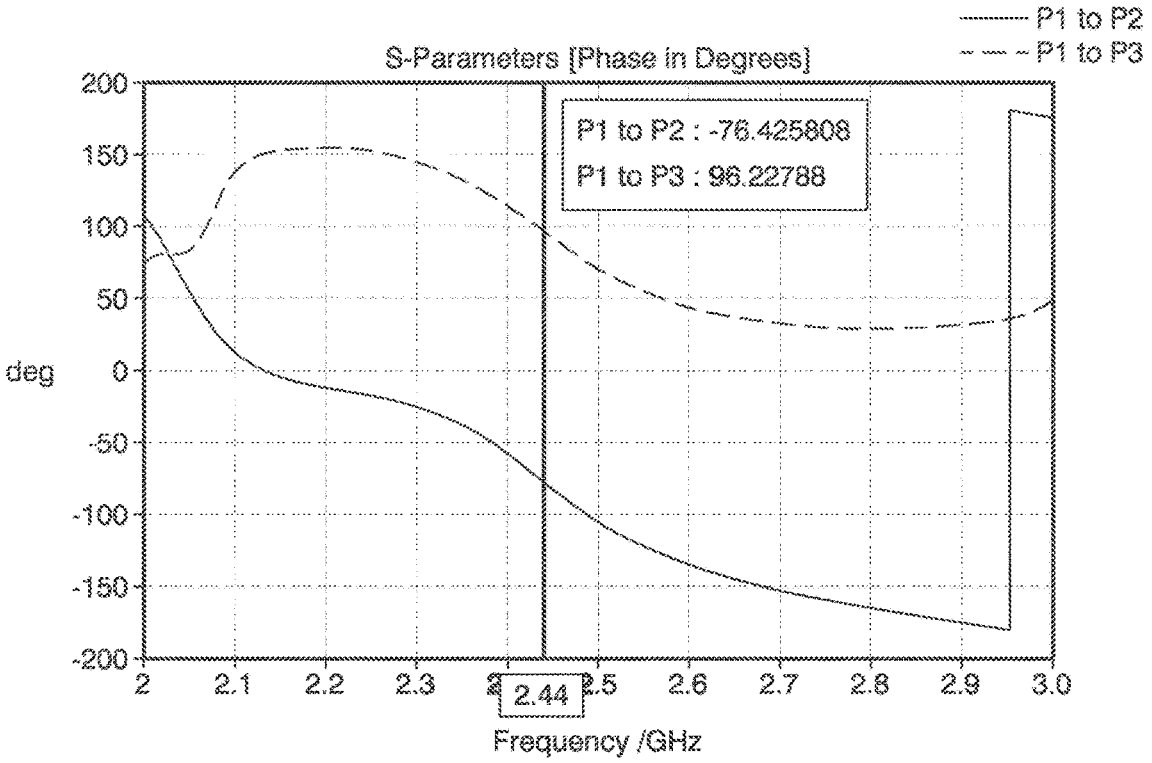
FIG. 7 is a graph of a phase of signals at different points in a cancelation circuit according to disclosed embodiments.
Figure 8:
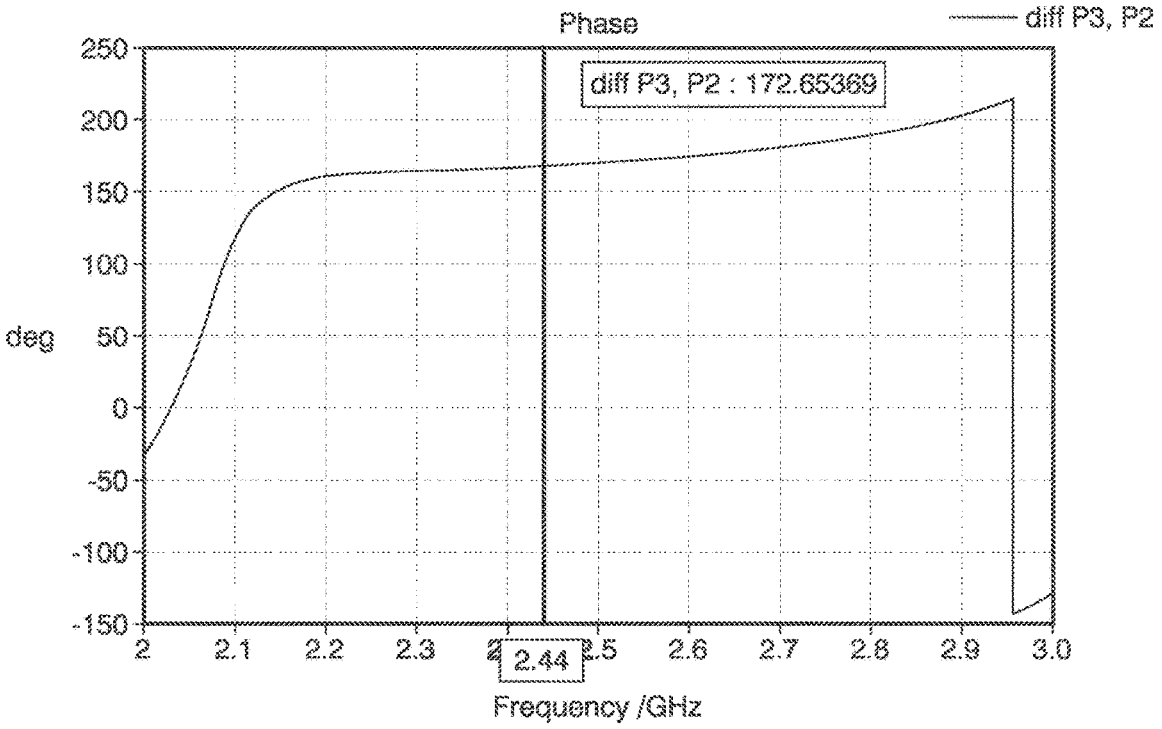
FIG. 8 is a graph of a phase difference of signals at different points in a cancelation circuit according to disclosed embodiments.

In operation, the cancelation circuit 28 can impart an approximately 180 degree phase shift on the signal received at the receiving port P3, thereby effectively canceling the signal received at the first receiving port P2 from the second antenna element 26 over the air. In this regard, FIG. 7 is a graph of a phase of the signals received at the first receiving port P2 and the second receiving port P3 from the active antenna port P1, and FIG. 8 is a graph of a phase difference of the signals received at the first receiving port P2 and the second receiving port P3 from the active antenna port P1. It is to be understood that the cancelation effect can occur in an opposite manner when the second radio connection point 36 is the active port.

Figure 9:
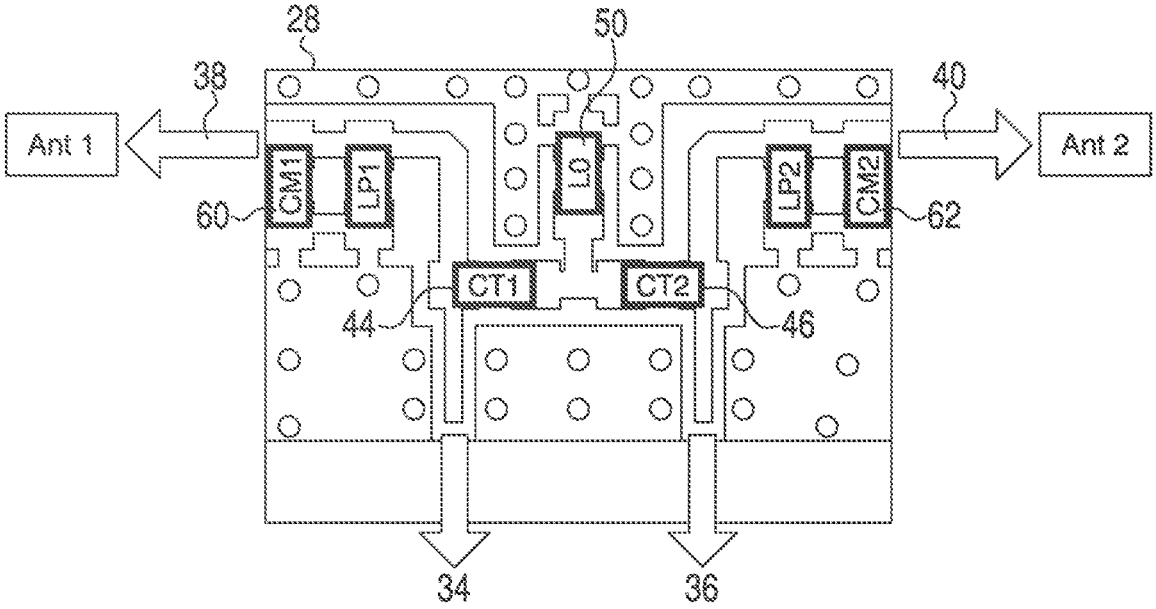
FIG. 9 is a schematic diagram of a cancelation circuit according to disclosed embodiments.

FIG. 9 is a schematic diagram of the cancelation circuit 28 according to disclosed embodiments. As seen in FIG. 9, in some embodiments, the first capacitor 44, the second capacitor 46, and the inductor 50 can be implemented as lumped-element components. As further seen in FIG. 9, in some embodiments, the first impedance shunt capacitor 60 and the second impedance shunt capacitor 62 can also be implemented as lumped-element components. As described herein, use of the lumped-element components can reduce an overall size of the RF antenna system 20 as compared with known prior art RF antenna systems. In some embodiments, the cancellation circuit 28 can also include inductors LP1, LP2, each of which can have an inductance of 18 nH.

Figure 2:
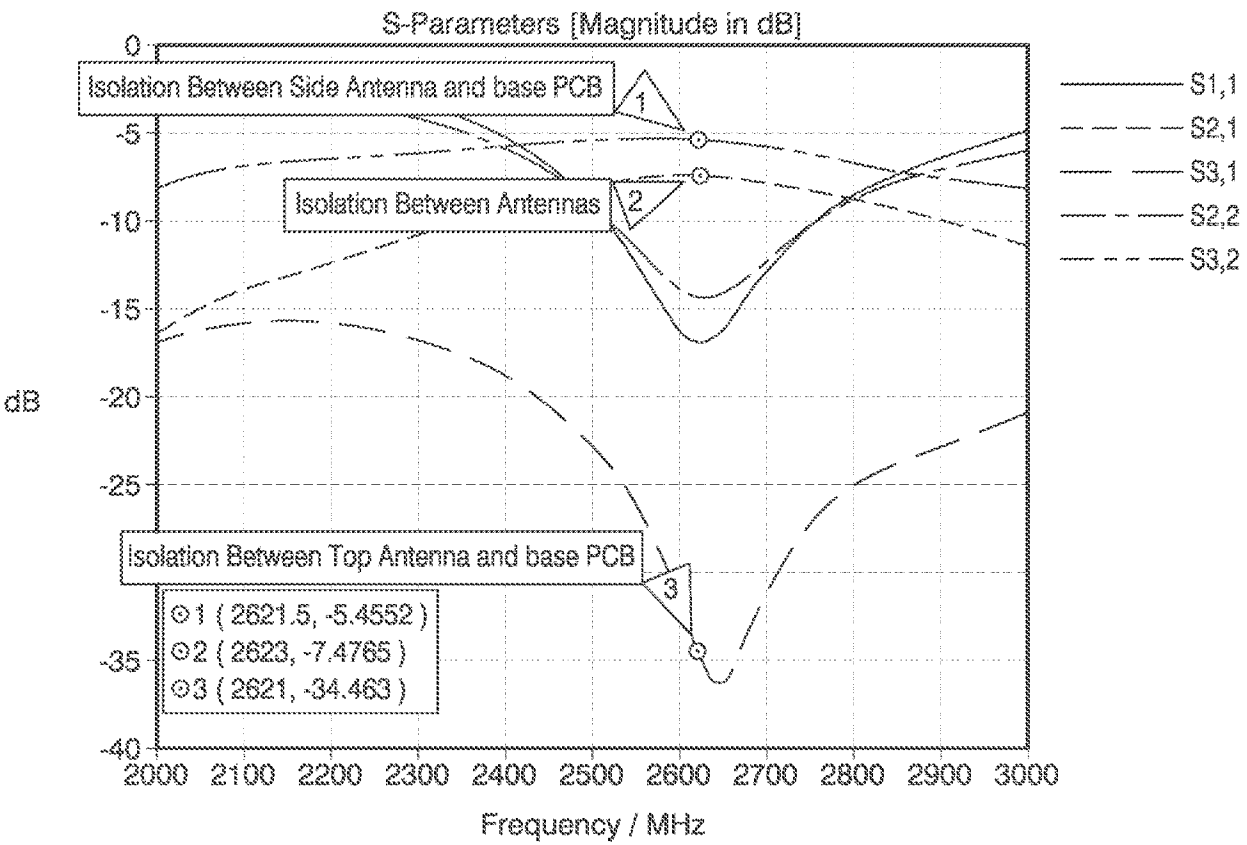
FIG. 2 Prior Art
FIG. 2 is a graph illustrating isolation properties of the antenna system of FIG. 1.
Figure 10:
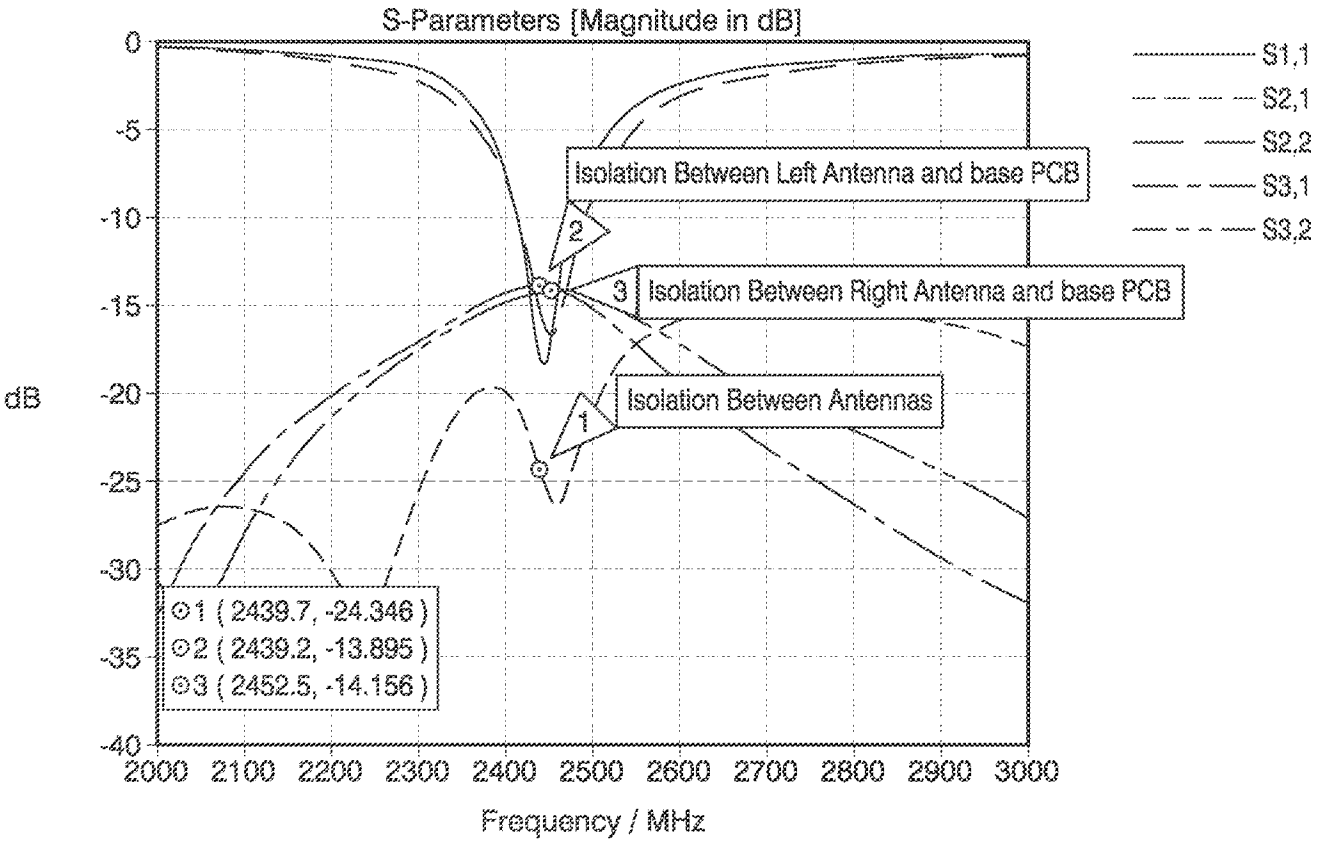
FIG. 10 is a graph illustrating isolation properties of an antenna system according to disclosed embodiments.
Figure 11A:
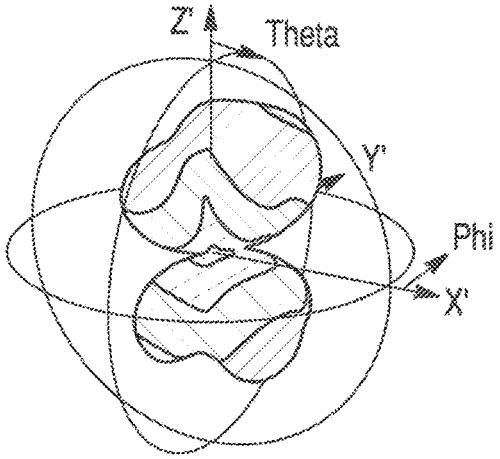
FIG. 11A is a 3D graph of vertical polarization of an antenna element of an antenna system according to disclosed embodiments.
Figure 11B:
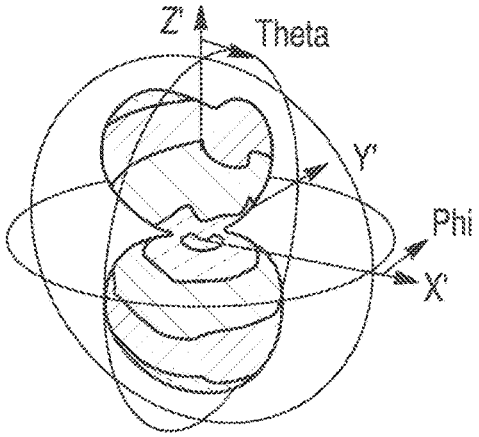
FIG. 11B is a 3D graph of vertical polarization of an antenna element of an antenna system according to disclosed embodiments.
Figure 11C:
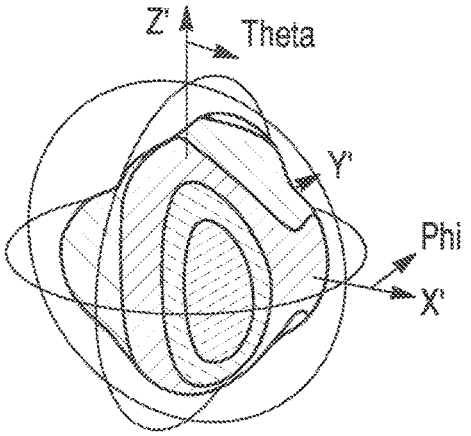
FIG. 11C is a 3D graph of horizontal polarization of an antenna element of an antenna system according to disclosed embodiments.
Figure 11D:
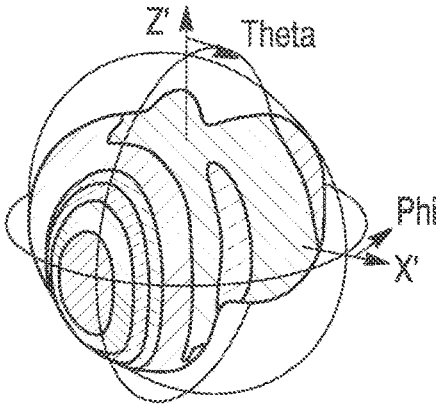
FIG. 11D is a 3D graph of horizontal polarization of an antenna element of an antenna system according to disclosed embodiments.
Figure 11E:
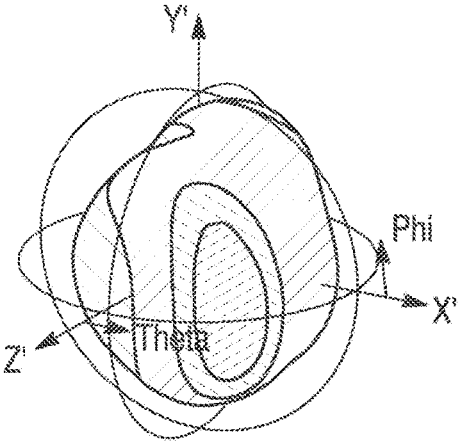
FIG. 11E is a 3D graph of total field of an antenna element of an antenna system according to disclosed embodiments.
Figure 11F:
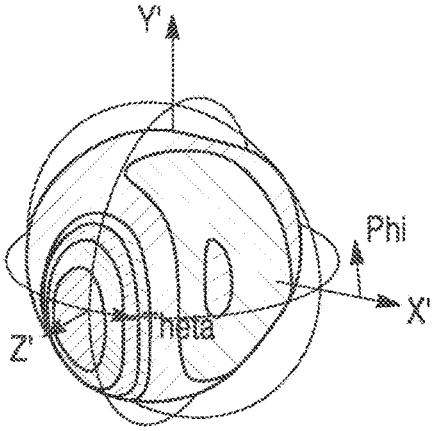
FIG. 11F is a 3D graph of total field of an antenna element of an antenna system according to disclosed embodiments.
Figure 12A:
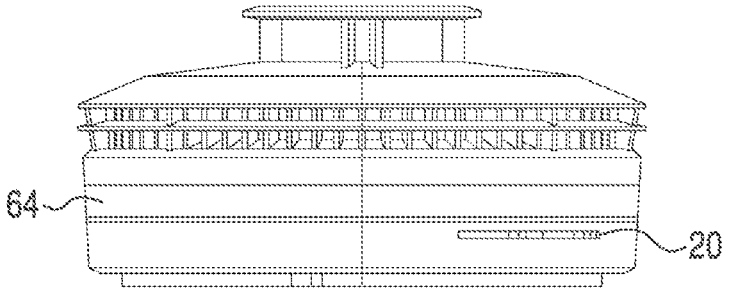
FIG. 12A is a side view of an antenna system enclosed in a housing and oriented in the Y-Z plane according to disclosed embodiments.
Figure 12B:
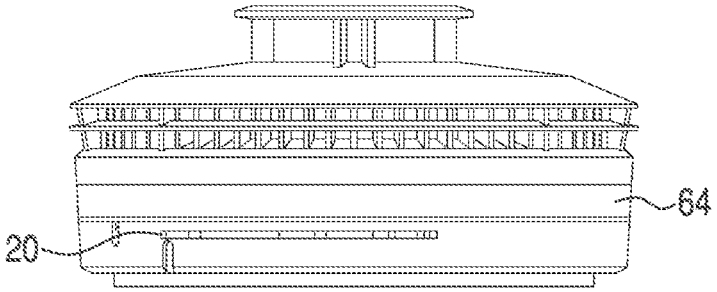
FIG. 12B is a side view of an antenna system enclosed in a housing and oriented in the X-Z plane according to disclosed embodiments.
Figure 12C:
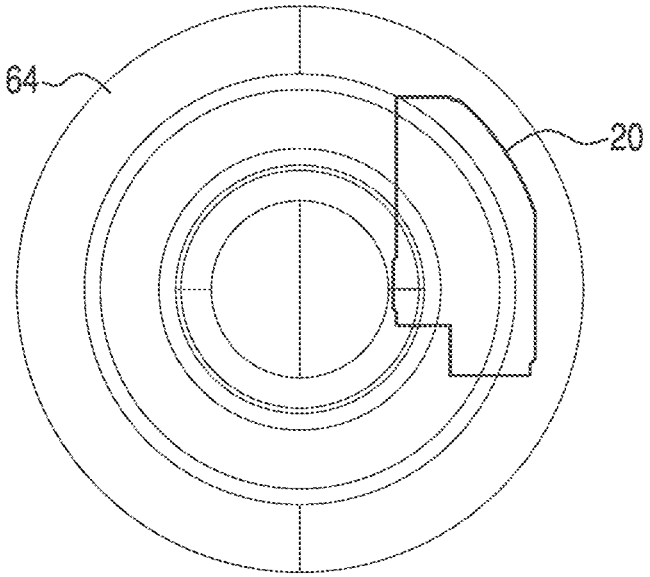
FIG. 12C is a top view of an antenna system enclosed in a housing and oriented in the X-Y plane according to disclosed embodiments.
Figure 13A:
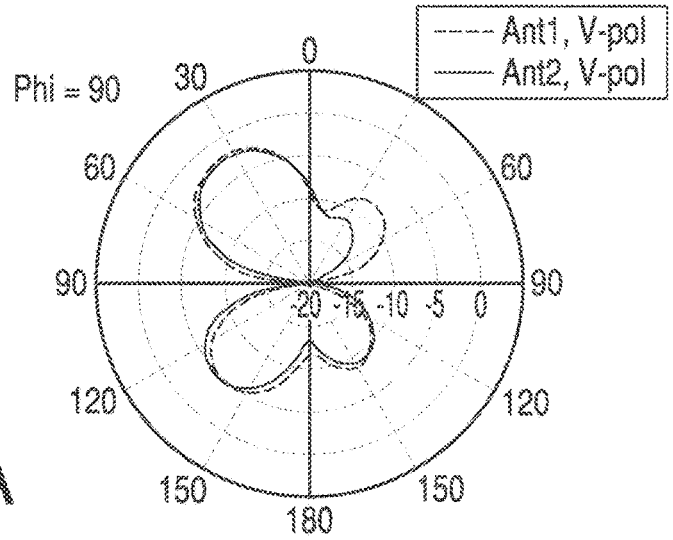
FIG. 13A is a 2D graph of vertical polarization of antenna elements of an antenna system in the Y-Z plane according to disclosed embodiments.
Figure 13B:
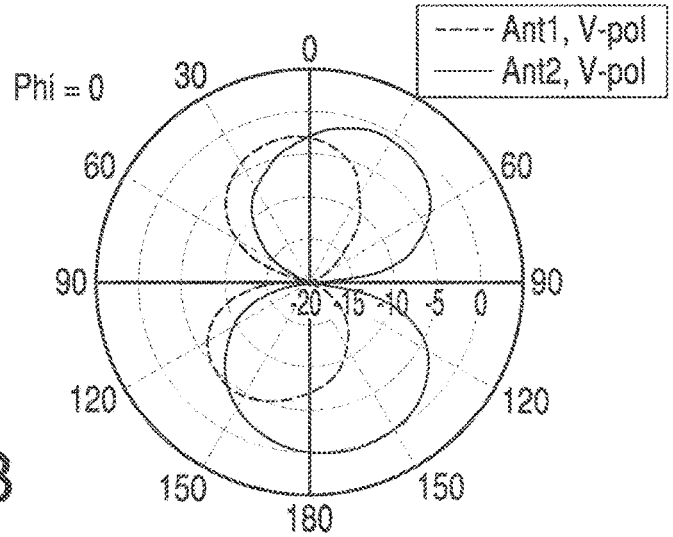
FIG. 13B is a 2D graph of vertical polarization of antenna elements of an antenna system in the X-Z plane according to disclosed embodiments.
Figure 13C:
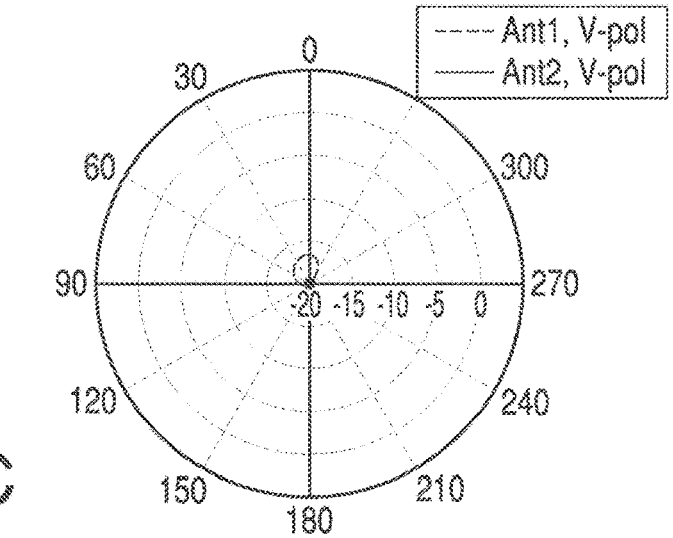
FIG. 13C is a 2D graph of vertical polarization of antenna elements of an antenna system in the X-Y plane according to disclosed embodiments.
Figure 14A:
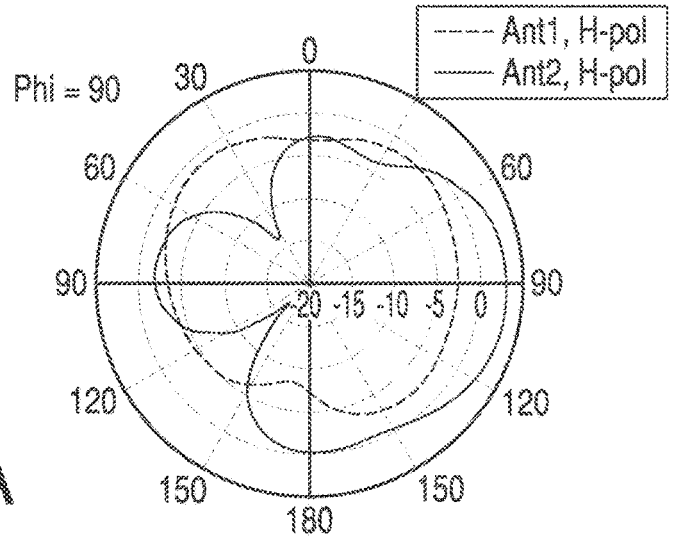
FIG. 14A is a 2D graph of horizontal polarization of antenna elements of an antenna system in the Y-Z plane according to disclosed embodiments.
Figure 14B:
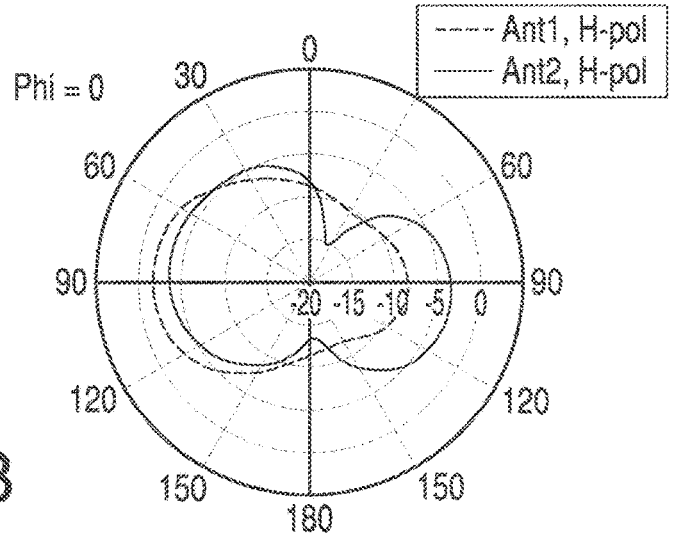
FIG. 14B is a 2D graph of horizontal polarization of antenna elements of an antenna system in the X-Z plane according to disclosed embodiments.
Figure 14C:
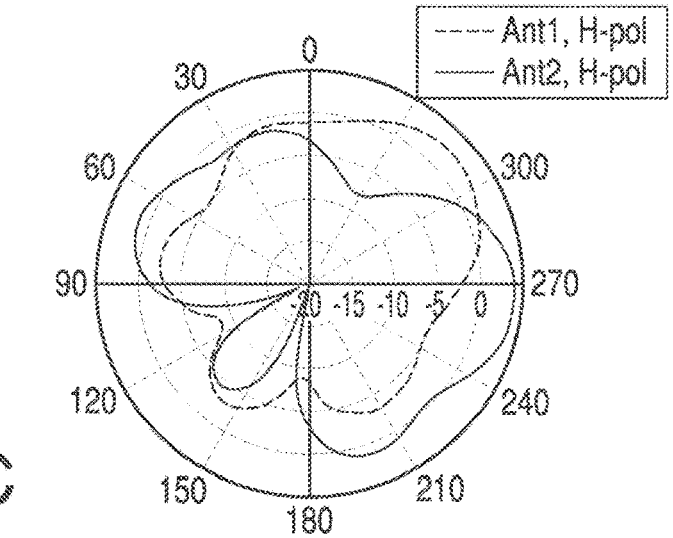
FIG. 14C is a 2D graph of horizontal polarization of antenna elements of an antenna system in the X-Y plane according to disclosed embodiments.

As explained above, the RF antenna system 20 described herein can provide very good isolation between the first and second antenna elements 24, 26 and the base PCB 30 and between the first antenna element 24 and the second antenna element 26. In this regard, FIG. 10 is a graph illustrating isolation properties of the RF antenna system 20 according to disclosed embodiments. As seen in FIG. 10, S1,1 represents a signal broadcast by the first antenna element 24, S2,2 represents a signal broadcast by the second antenna element 26, S2,1 represents the isolation between the first antenna element 24 and the second antenna element 26, S3,1 represents the isolation between the base PCB 30 and the first antenna element 24, and S3,2 represents the isolation between the base PCB 30 and the second antenna element 26. As seen in FIG. 10 when compared to FIG. 2, the RF antenna system 20 described herein can improve the isolation properties of known RF antenna systems.

Figure 15A:
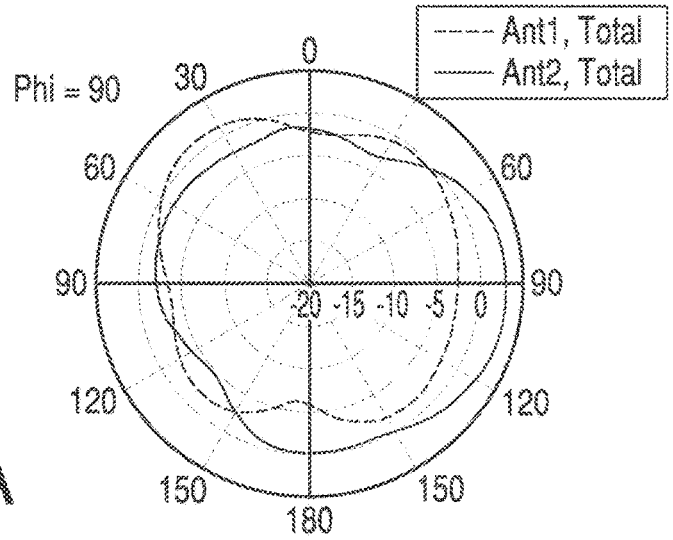
FIG. 15A is a 2D graph of total field of antenna elements of an antenna system in the X-Z plane according to disclosed embodiments.
Figure 15B:
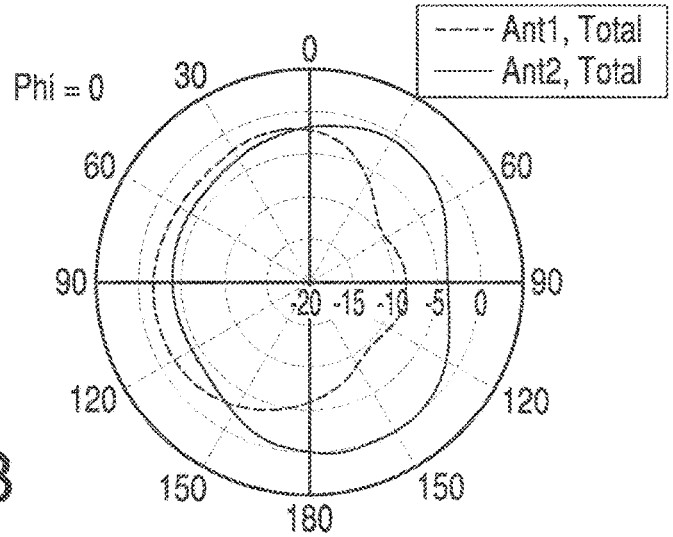
FIG. 15B is a 2D graph of total field of antenna elements of an antenna system in the X-Z plane according to disclosed embodiments.
Figure 15C:
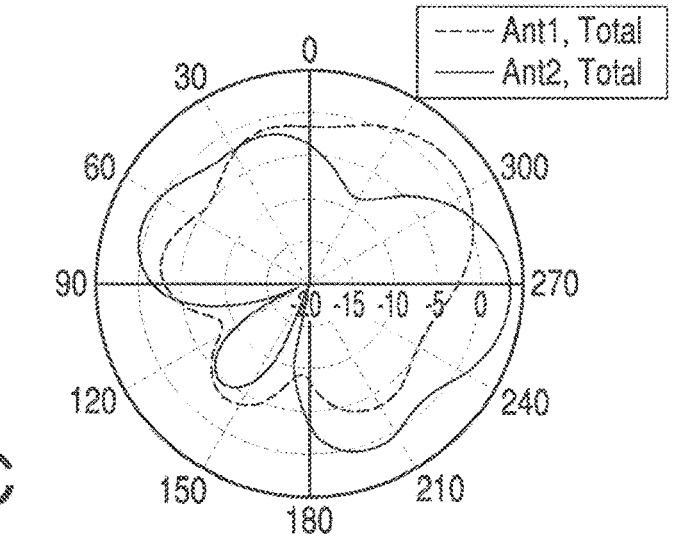
FIG. 15C is a 2D graph of total field of antenna elements of an antenna system in the X-Y plane according to disclosed embodiments.

To further illustrate such improvements, FIGS. 11A-15C are provided. Specifically, FIGS. 11A-11F are 3D graphs of vertical polarization, horizontal polarization, and total field of the first antenna element 24 and the second antenna element 26 according to disclosed embodiments. Furthermore, FIGS. 12A-12C are side and top views of the RF antenna system 20 enclosed in a housing 64 and oriented in the Y-Z, X-Z, and X-Y planes according to disclosed embodiments, FIGS. 13A-13C are 2D graphs of the vertical polarization of the first antenna element 24 and the second antenna element 26 in the Y-Z, X-Z, and X-Y planes according to disclosed embodiments, FIGS. 14A-14C are 2D graphs of the horizontal polarization of the first antenna element 24 and the second antenna element 26 in the Y-Z, X-Z, and X-Y planes according to disclosed embodiments, and FIGS. 15A-15C are 2D graphs of the total field of the first antenna element 24 and the second antenna element 26 in the Y-Z, X-Z, and X-Y planes according to disclosed embodiments.

Figure 16:
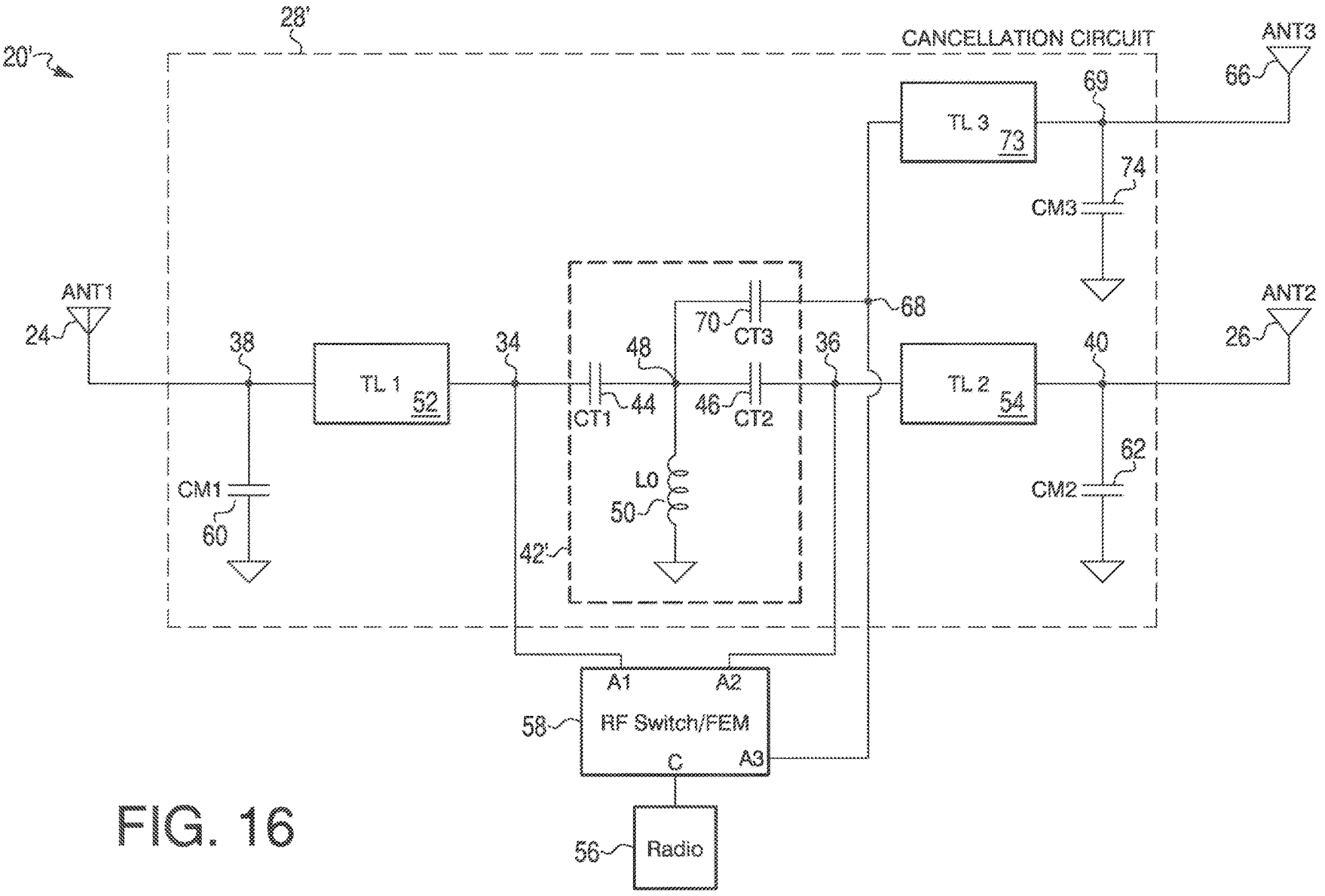
FIG. 16. is a schematic diagram of an antenna system according to disclosed embodiments.

Although the RF antenna system 20 shown and described herein includes two antenna elements 24, 26, it is to be understood that embodiments disclosed herein are not so limited and can include three or more antenna elements. For example, FIG. 16 is a schematic diagram of an RF antenna system 20' that includes the first antenna element 24, the second antenna element 26, a third antenna element 66, and a cancelation circuit 28'. As seen in FIG. 16, when the RF antenna system 20' includes three antenna elements, the cancelation circuit 28' can be similar to the cancelation circuit 28 of FIG. 5, but include a third radio connection point 68, a third antenna feed point 69 electrically coupled to the third radio connection point 68, a third transmission line 73, a third impedance shunt capacitor 74, and a filter 42' coupled to the third radio connection point 68 to provide the cancelation effect as described in connection with FIGS. 5-8.

For example, in some embodiments, the filter 42' can include a third capacitor 70 electrically coupled to the third radio connection point 68 and the third transmission line 73 can electrically couple the third feed connection point 69 to the third radio connection point 68, which can be electrically coupled to the radio 56 via the RF switch 58. Furthermore, the third impedance shunt capacitor 74 can be coupled between the third antenna feed point 69 and ground.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A radio frequency cancelation circuit comprising:

a first radio connection point;

a second radio connection point;

a first antenna feed point electrically coupled to the first radio connection point;

a second antenna feed point electrically coupled to the second radio connection point; and a filter electrically coupled between the first radio connection point and the second radio connection point to provide a cancelation effect at the first radio connection point and the second radio connection point with respect to signals broadcast over air by a first antenna element coupled to the first antenna feed point and a second antenna element coupled to the second antenna feed point, wherein the first radio connection point includes an active antenna port that is configured to receive a signal to be broadcast by the first antenna element, wherein the second radio connection point includes a first receiving port and a second receiving port, and wherein the first receiving port is configured to receive a signal through the second antenna element and the second receiving port is configured to receive a signal through the filter.

2. The radio frequency cancelation circuit of claim 1 wherein the filter provides a phase shift on signals conducted through the cancelation circuit to provide the cancelation effect.

3. The radio frequency cancelation circuit of claim 2 wherein the filter includes a first capacitor electrically coupled to the first radio connection point, a second capacitor electrically coupled to the second radio connection point and to the first capacitor at a capacitor connection point, and an inductor electrically coupled between ground and the capacitor connection point.

4. The radio frequency cancelation circuit of claim 3 wherein the first capacitor, the second capacitor, and the inductor are implemented as lumped-element components.

5. The radio frequency cancelation circuit of claim 3 further comprising:

a first transmission line electrically coupling the first radio connection point to the first feed connection point; and a second transmission line electrically coupling the second radio connection point to the second feed connection point, wherein changes to capacitance of the first capacitor and the second capacitor, inductance of the inductor, or lengths of the first transmission line and the second transmission line change a frequency at which the cancelation effect occurs.

6. The radio frequency cancelation circuit of claim 1 further comprising:

a first impedance shunt capacitor electrically coupled between ground and the first antenna feed point; and a second impedance shunt capacitor electrically coupled between the ground and the second antenna feed point.

* * * * *